US009599086B2

(12) United States Patent
Smith

(10) Patent No.: US 9,599,086 B2
(45) Date of Patent: Mar. 21, 2017

(54) FUEL SYSTEM CONTROL

(75) Inventor: Michael David Smith, Huntingdon (GB)

(73) Assignee: Perkins Engines Company Limited, Peterborough (GB)

( * ) Notice: Subject to any disclaimer, the term of this patent is extended or adjusted under 35 U.S.C. 154(b) by 251 days.

(21) Appl. No.: 14/347,745

(22) PCT Filed: Sep. 12, 2012

(86) PCT No.: PCT/GB2012/052250
§ 371 (c)(1),
(2), (4) Date: Mar. 27, 2014

(87) PCT Pub. No.: WO2013/045890
PCT Pub. Date: Apr. 4, 2013

(65) Prior Publication Data

US 2014/0216407 A1 Aug. 7, 2014

(30) Foreign Application Priority Data

Sep. 30, 2011 (GB) ..... 1116903.4

(51) Int. Cl.
*F02M 69/52* (2006.01)
*F02D 41/22* (2006.01)
(Continued)

(52) U.S. Cl.
CPC ..... *F02M 69/52* (2013.01); *F02D 41/22* (2013.01); *F02D 41/3845* (2013.01);
(Continued)

(58) Field of Classification Search
CPC .. F02D 41/22; F02D 41/3845; F02D 41/3863; F02D 2041/224; F02D 2200/0602; F02M 63/005; F02M 69/52; F02M 69/0225
(Continued)

(56) References Cited

U.S. PATENT DOCUMENTS 6,250,285 B1 6/2001 Takase
6,474,294 B2 * 11/2002 Yamazaki ..... F02D 41/042 123/179.4
(Continued)

FOREIGN PATENT DOCUMENTS

CN 101498264 8/2009
DE 19626689 7/1996
(Continued)

*Primary Examiner* — Stephen K Cronin
*Assistant Examiner* — Susan E Scharpf

(57) ABSTRACT

A method of controlling a fuel system includes determining the opening of a pressure relief valve and initiating a reseat strategy for the valve. The fuel system comprises a source of high pressure fuel and a pressure relief valve having at least one inlet fluidly coupled to the source of high pressure fuel and at least one outlet. The pressure relief valve has a closed position and at least one open position in which fuel is able to pass from the inlet to the outlet. The method comprises the steps of continuously measuring the pressure of the fuel in the fuel source, determining whether the pressure relief valve is in an open position, and generating an open signal if it is determined that the pressure relief valve is in an open position.

18 Claims, 3 Drawing Sheets

(51) Int. Cl.
*F02D 41/38* (2006.01)
*F02M 63/00* (2006.01)
*F02M 63/02* (2006.01)

(52) U.S. Cl.
CPC ..... *F02D 41/3863* (2013.01); *F02M 63/005* (2013.01); *F02D 2041/224* (2013.01); *F02D 2200/0602* (2013.01); *F02M 63/0225* (2013.01)

(58) Field of Classification Search
USPC ..... 123/446, 447–450
See application file for complete search history.

(56) References Cited

U.S. PATENT DOCUMENTS 6,715,468 B2 * 4/2004 Uchiyama ..... F02D 41/221 123/339.15
6,871,633 B1 * 3/2005 Date ..... F02D 33/006 123/445
6,966,300 B2 * 11/2005 Fukuda ..... F02M 59/366 123/357
7,412,968 B2 * 8/2008 Takayanagi ..... F02D 41/222 123/198 D
7,451,038 B2 * 11/2008 Kosiedowski ..... F02D 41/3863 123/506
7,469,683 B2 * 12/2008 Mason ..... F02M 37/0023 123/509
7,523,743 B1 * 4/2009 Geveci ..... F02D 41/3863 123/456
7,610,901 B2 * 11/2009 Bucher ..... F02D 41/221 123/457
7,690,361 B2 4/2010 Vogt et al.
7,848,868 B2 * 12/2010 Nakagawa ..... F02D 41/3863 123/357
7,854,160 B2 * 12/2010 Elkolaly ..... G01M 15/09 73/114.43
7,950,371 B2 * 5/2011 Cinpinski ..... F02D 41/221 123/446
2006/0196476 A1 9/2006 Stockner
2007/0079808 A1 * 4/2007 Takahashi ..... F02D 41/221 123/447
2008/0103674 A1 5/2008 Kosiedowski et al.
2010/0122690 A1 5/2010 Miyake et al.
2011/0094476 A1 * 4/2011 Ibrahim ..... F02M 55/007 123/456
2011/0139126 A1 6/2011 Inoue

FOREIGN PATENT DOCUMENTS

DE 19800760 1/1998
DE 19937962 8/1999
DE 102006040441 8/2006
DE 102009001760 10/2009
EP 0780559 7/1996
EP 2085596 8/2009
FR 2750735 1/1998
JP 1998227268 8/1998
WO 2010136302 12/2010
WO 2013045890 4/2013

* cited by examiner

FUEL SYSTEM CONTROL

TECHNICAL FIELD

The present disclosure relates to improvements in the control of a fuel system in an engine such as a combustion engine and in particular to a method of controlling the fuel system by determining the opening of a pressure relief valve and initiating a reseat strategy for the valve.

BACKGROUND

Many different fuel systems are utilized to introduce fuel into the combustion chambers of an engine. One type of fuel system is known as the common rail system. A typical common rail fuel system utilizes one or more pumping mechanisms to pressurize fuel and direct the pressurized fuel to a common manifold, also known as a common rail, which provides a source of pressurised fuel. A plurality of fuel injectors draw pressurized fuel from the common rail and inject one or more shots of fuel per cycle into the combustion chambers. In order to optimize engine operation, fuel within the rail is maintained within a desired pressure range through the precise control of the pumping mechanisms.

Situations may arise in which this precise control is interrupted, pressure fluctuations or spikes occur, or various portions of the fuel system fail. In these situations, there is a possibility that fuel pressures within the common rail could reach levels that have the potential to damage the components of the fuel system. One way to protect the common rail from such excessive pressures is to selectively drain fuel from the common rail as the pressure of the fuel within it exceeds a predetermined maximum threshold value. However, if too much fuel is drained, the pressure of the fuel within the common rail may drop below a certain minimum pressure (at which the fuel injectors and engine will be able to continue operating in at least a limited operational mode, or "limp home" mode) and the engine may shut off. If the engine shuts off suddenly the machine, truck, or other piece of equipment powered by the engine may be left in an undesirable state, position, or location. Moreover, depending on the problem or problems that lead to the excessive pressure within the fuel system, the rate at which the fuel will need to be drained from the common rail to maintain a required minimum pressure may vary.

The incorporation of a pressure relief (or limiter) valve into such a fuel system helps to mitigate, reduce, or even eliminate the adverse effects of excessive fluid pressure on the common rail. When the pressure of the fluid within the system exceeds a maximum threshold value, the pressure relief valve opens and allows fluid to drain from the common rail, thereby lowering the pressure of the fluid within the common rail. The pressure of the fluid may be lowered just enough to protect the common rail without creating instability or completely disabling the system. This means that the engine can still operate.

US-A-2011/0094476 describes a fuel supply system incorporating a pressure relief valve. The pressure relief valve comprises a movable valve member and a resilient member housed in a body which has a fluid inlet and two fluid outlets. The resilient member biases the valve member into a first (closed) position in which the fluid inlet is fluidly blocked from the first outlet and the second outlet. The valve also has a second (open) position in which the inlet is fluidly coupled to the first outlet, but not to the second outlet and a third (open) position in which the inlet is fluidly coupled to both the first and the second outlets, which allows a greater flow of fluid out of the common rail than the second position.

It has been determined that the detection of the opening of the pressure relief valve is useful to aid troubleshooting of low fuel rail pressure problems. It may also be used to trigger a process to attempt to close the pressure relief valve to enable continued use of the machine driven by the engine. It is also recognised that there are some transient conditions which cause the pressure relief valve to open, such as air ingress during a filter change, which cause a rail pressure overshoot which can be remedied quickly, in which case it is desirable to shorten the time taken to reseat the valve and thereby reduce the impact on the machine operator as a result of the engine suddenly losing power.

SUMMARY

According to the disclosure there is provided a method of controlling a fuel system of an engine, said fuel system comprising:

- a source of high pressure fuel;
- a pressure relief valve having at least one inlet fluidly coupled to the source of high pressure fuel and at least one outlet;
  - said pressure relief valve having a closed position in which fuel is not able to pass from the at least one inlet to the at least one outlet and at least one open position in which fuel is able to pass from the at least one inlet to the at least one outlet;

said method comprising the steps of:

- continuously measuring the pressure of the fuel in the fuel source;
- determining whether the pressure relief valve is in an open position by comparing the measured pressure to at least one preset pressure threshold; and generating an open signal if it is determined that the pressure relief valve is in an open position.

The disclosure further provides a fuel system for an engine comprising:

- a method of controlling a fuel system of an engine, said fuel system comprising:
- a source of high pressure fuel;
- a pressure relief valve having at least one inlet fluidly coupled to the source of high pressure fuel and at least one outlet;
  - said pressure relief valve having a closed position in which fuel is not able to pass from the at least one inlet to the at least one outlet and at least one open position in which fuel is able to pass from the at least one inlet to the at least one outlet;
  - wherein the pressure relief valve is actuated such that when the pressure of the fuel in the fuel source exceeds a valve opening pressure, the fuel pressure causes the pressure relief valve to move to a first open position;

said method comprising the steps of:

- continuously measuring the fuel pressure in the fuel source;
- determining whether the pressure relief valve is in an open position by determining whether the measured pressure is equal to or greater than a preset pressure threshold, which is set at the valve opening pressure; and generating an open signal if it is determined that the pressure relief valve is in an open position.

DETAILED DESCRIPTION

Figure 1:
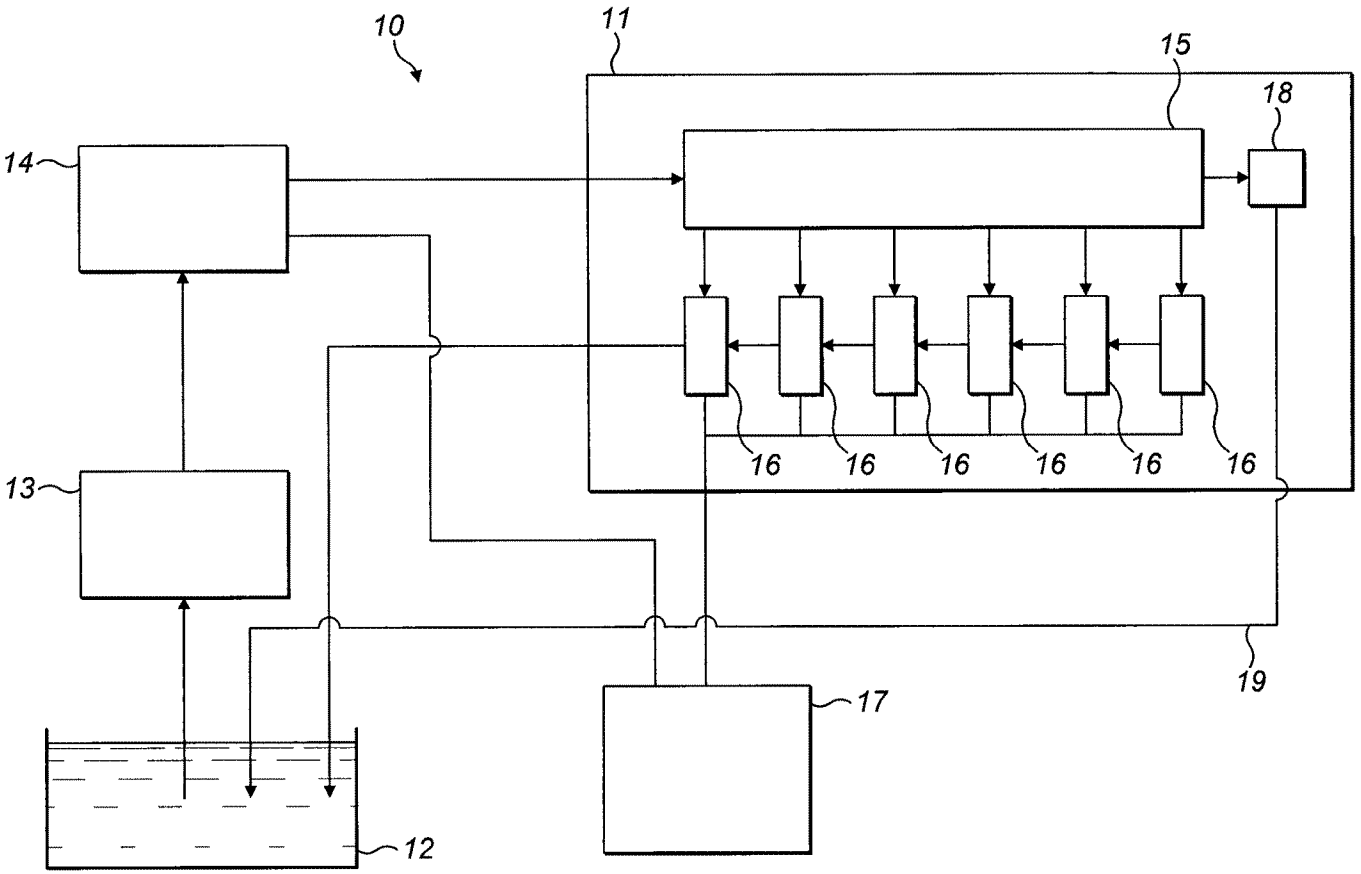
FIG. 1 is a schematic representation of a fuel system incorporating a pressure relief valve.

FIG. 1 illustrates one exemplary embodiment of a fuel system 10. The fuel system 10 is designed to deliver fuel (e.g. diesel, gasoline, heavy fuel, etc.) from a location where fuel is stored to the combustion chamber(s) of an engine 11 where it will be combusted. The energy released by the combustion process is captured by the engine 11 and used to generate a mechanical source of power. Although FIG. 1 shows a fuel system for a diesel engine, the fuel system 10 of the present disclosure may be the fuel system of any type of engine (e.g. an internal combustion engine such as a gaseous fuel or gasoline engine, a turbine etc.). The fuel system 10 of FIG. 1 may include a fuel source such as a tank 12, a transfer pump 13, a high-pressure pump 14, a common rail 15, a plurality of fuel injectors 16, an electronic control module (ECM) 17 and a pressure relief valve 18.

The tank 12 is typically a storage container that stores the fuel that the fuel system 10 will deliver to the engine 11. The transfer pump 13 pumps fuel from the tank 12 and delivers it at a generally low pressure to the high-pressure pump 14. The high-pressure pump 14 pressurizes the fuel to a high pressure and delivers the fuel to the common rail 15. The common rail 15, which is intended to be maintained at the high pressure generated by high-pressure pump 14, serves as the source of high-pressure fuel for each of the fuel injectors 16. The fuel injectors 16 are located within the engine 11 in a position that enables the fuel injectors 16 to inject high-pressure fuel into the combustion chambers of the engine 11 (or into pre-chambers or ports upstream of the combustion chamber in some cases). The fuel injectors 16 generally serve as metering devices that control when fuel is injected into the combustion chamber, how much fuel is injected, and the manner in which the fuel is injected (e.g. the angle of the injected fuel, the spray pattern, etc.). Each fuel injector 16 is continuously fed fuel from the common rail 15 such that any fuel injected by a fuel injector 16 is quickly replaced by additional fuel supplied by common rail 15. The ECM 17 is a control module that receives multiple input signals from sensors associated with various systems of engine 11 (including the fuel system 10) indicative of the operating conditions of those various systems (e.g. common rail fuel pressure, fuel temperature, throttle position, engine speed, etc.). The ECM 17 uses the input signals to control the fuel system 10 which includes, inter alia, the operation of the high-pressure pump 14 and each of the fuel injectors 16. The general purpose of the fuel system 10 is to ensure that the fuel is constantly fed to the engine 11 in the appropriate amounts, at the right times, and in the right manner to support the operation of the engine 11.

The pressure relief valve (PRV) 18 is a component or assembly that selectively directs fuel from the common rail 15 to the tank 12 via a drain line 19 when the pressure of the fuel within common rail 15 exceeds a certain threshold magnitude, which will depend on the characteristics of each particular fuel system.

Figure 2:
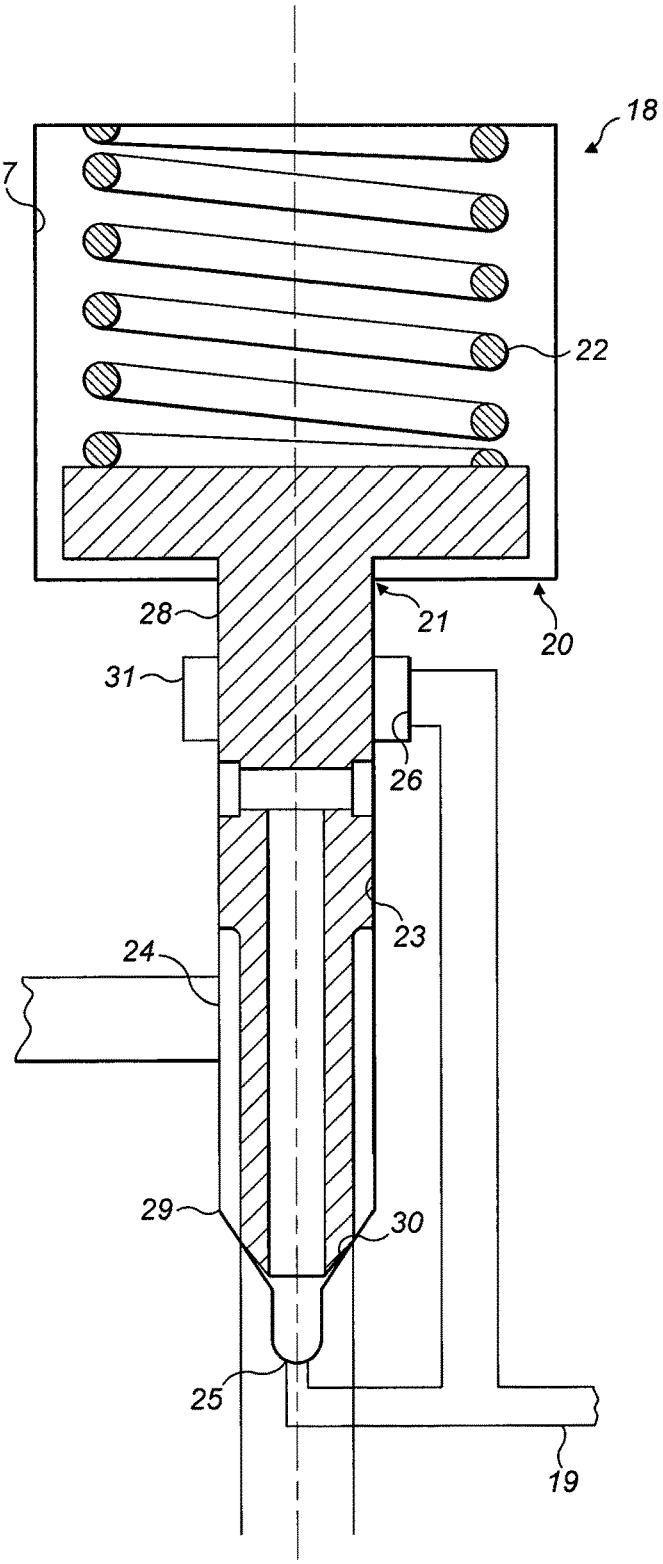
FIG. 2 is a cross sectional front elevation of a pressure relief valve shown in a closed position.

The construction of the pressure relief valve may be of any suitable construction. One suitable (but not limiting) construction, as described in detail in US-A-2011/0094476, is illustrated in FIG. 2. In this construction the pressure relief valve 18 comprises a body 20, a valve member 21 and a resilient member 22, such as a spring.

The body 20 is a generally rigid member or assembly that houses the valve member 21 and the resilient member 22 and defines flow passages that allow fuel to flow from a high pressure region (e.g. the common rail 15) to a low pressure region (e.g. the tank 12). The body 20 may include a bore 23, at least one inlet 24, at least one outlet including a first outlet 25 and may be also a second outlet 26, and a spring chamber 27.

The bore 23 may be configured to receive at least a portion of the valve member 21. The bore 23 may include a proximal end 28 that is located near the spring chamber 27 and a distal end 29. At the distal end 29, bore 23 may include a seat surface 30 that is configured to be engaged by an end portion of valve member 21 to create a sealed interface that prevents (or substantially prevents) any flow of fluid from the inlet around valve member 21 into first outlet 25.

The inlet 24 may be a passageway, duct, or other opening within the body 20 that opens into the bore 23 and that serves to fluidly couple the common rail 15 to the bore 23. The inlet 24 may enter the bore 23 in a radial direction.

The first outlet 25 may be a passageway, duct, or other opening within the body 20 that serves to fluidly couple the bore 23 to the tank 12 via the drain line 19. The first outlet 25 may be located near the distal end 29 of the bore 23 and may by positioned on the opposite side of the seat surface 30 to the inlet 24. Thus the engagement of the valve member 21 with the seat surface 30 fluidly blocks the inlet 24 from the first outlet 25.

The second outlet 26 may be a passageway, duct, or opening within the body 20 that serves to fluidly couple the bore 23 to the tank 12 via the drain line 19. The second outlet 26 may be located generally near the proximal end 28 of the bore 23 such that along the length of the bore 23, the inlet 24 is located between the first outlet 25 and the second outlet 26. To facilitate the flow of fuel into the second outlet 26 from different positions around the circumference of bore 23, an annulus or circumferential groove 31 may be provided within the bore 23.

The spring chamber 27 is an opening or cavity within the body 20 that is configured to receive a portion of the valve member 21 and the resilient member 22.

The pressure relief valve 18 may be coupled within the fuel system 10 such that the inlet 24 is in fluid communication with the common rail 15 to receive fuel there from, and the first and second outlets 25, 26 are both ultimately coupled to the tank 12 via drain line 19.

INDUSTRIAL APPLICABILITY

During operation of the fuel system 10, the transfer pump 13 draws fuel from the tank 12 and provides the fuel to the high pressure pump 14. The high pressure pump 14 pressurizes the fuel to a high pressure and directs the high pressure fuel to the common rail 15. The fuel is then directed from the common rail 15 to each of the fuel injectors 16.

Fuel from the common rail 15 will enter the bore 23 of the pressure relief valve 18 via the inlet 24. When the valve member 21 is in a first (closed) position (illustrated in FIG. 2), the force provided by the resilient member 22 is equal to the pressure of the fuel within common rail 15. When the pressure within common rail 20 exceeds a certain threshold pressure (referred to as "the valve opening pressure"), it generates an opening force that exceeds the biasing force provided by resilient member 22, and the valve member 21 will move away from seat surface 30 to a second (open) position and the seal therebetween will be broken. When the valve member 21 moves to this second position fuel is allowed to drain into the first outlet 25.

Depending on the characteristics of resilient member 22 (e.g. the spring constant k in the case of a compression spring), the flow of fuel trying to pass through the pressure relief valve 18, and the size of the first outlet 25, the pressure under the valve member 21 may rise to a level that causes the valve member 21 to move farther away from the seat surface 30 to a third (open) position. When the valve member 30 travels to this third position it has lifted enough to allow the inlet 24 to fluidly communicate with second outlet 26. Thus, when the valve member 21 reaches the third position, a second outlet for fuel is created that makes it possible for a greater flow of fuel to pass through the pressure relief valve 18 to the tank 12.

Once the valve member 21 is moved out of the first (closed) position, it will not close again until the force generated by the fuel pressure acting under the valve member 21 is less than the biasing force provided by the resilient member 22. The magnitude of the pressure that will allow the valve member 21 to close (referred to as "the valve closing pressure") will depend on the biasing force provided by the resilient member 22 and the size of the bore area.

According to the present disclosure the electronic control module (ECM) 17 provides a method of controlling the fuel system which includes the step of determining whether the pressure relief valve 18 has opened which, as described above, occurs when the fuel rail pressure exceeds the valve opening pressure. When it has been determined that the pressure relief valve 18 has opened, the ECM 17 regulates the pressure in the common rail 15, by controlling the operation of the high pressure pump 14, to a low rail pressure (i.e. referred to as the "regulated opening pressure") that is still sufficient to allow the engine to continue running at a minimum level, for example in a "limp home" mode.

Through analysis of the rail pressure signal fed to the ECM 17, if the ECM 17 determines the presence of a number of particular characteristics, this will be considered to indicate that the pressure relief valve 18 has opened. These characteristics are:

a) That the measured pressure in the common rail 15 (or other pressurised fuel source) was high enough to open the pressure relief valve 18, i.e. it exceeded the valve opening pressure;

b) That there was a subsequent rapid drop in the measured pressure to the regulated opening pressure; and c) That the measured pressure stays at or below the regulated opening pressure.

If these characteristics are all present, it is determined that the pressure relief valve 18 has opened and a valve closing procedure can be initiated.

Figure 3:
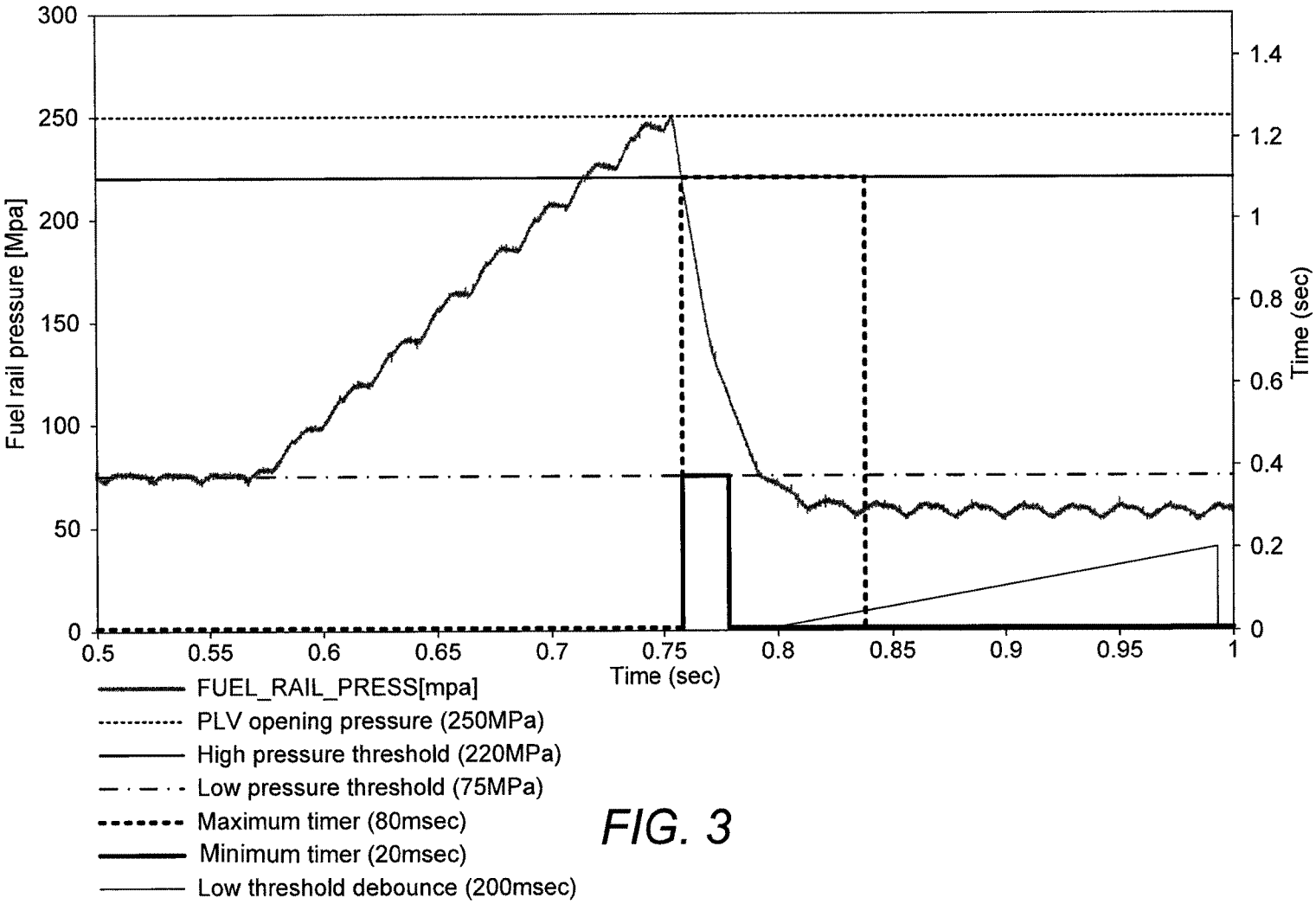
FIG. 3 is a graph illustrating the rail pressure signal.

This is illustrated in the graph of FIG. 3 which represent the measured fuel pressure (MPa) against time. The ECM 17 is programmed with a number of parameters to enable this determination, namely a high pressure threshold; a low pressure threshold; a maximum time limit (Maximum Timer); a minimum time limit (Minimum Timer); and a low threshold debounce period.

In the illustrated (non-limiting) example the high pressure threshold is set in the order of 220 MPa, which may be below the valve opening pressure, in this example at approximately 30 MPa below a valve opening pressure of 250 MPa. The high pressure threshold is set below the valve opening pressure because if the pressure relief valve 18 keeps opening multiple times, the valve opening pressure decreases due to mechanical wear of the valve seating surfaces 30. Another reason for the high pressure threshold to be set lower than the valve opening pressure is due to the discrete sampling of the measured pressure the peak pressure point can become aliased. In the illustrated example the maximum time limit is set at 80 msec, the minimum time limit is set at 20 msec and the low threshold debounce period is set at 200 msec.

The following control logic is used by the ECM 17 to determine whether the characteristics are present and whether the pressure relief valve 18 has opened.

Checks are made for the following sequence of conditions:

the measured pressure falling below the preset high pressure threshold. When this occurs two timers are started (the Maximum Timer and the Minimum Timer) and the measured pressure is monitored to determine whether it falls below the preset low pressure threshold. The Timers may alternatively be started when the measured pressure falls below the valve opening pressure.

If the measured pressure falls below the preset low pressure threshold before the Maximum Timer reaches the preset maximum time limit, the pressure relief valve 18 is provisionally determined as having opened.

The opening of the pressure relief valve 18 is then confirmed by checking that the measured pressure stays below the preset low pressure threshold during the preset low threshold debounce period.

If the three conditions above are all met, as illustrated in FIG. 3, then the pressure relief valve 18 is confirmed as having opened and a signal generated by the ECM 17.

Continuous checks are made to reset the above sequence of conditions when the following characteristics prevail which lead to a determination that the pressure relief valve 18 has not opened:

When the measured pressure exceeds the preset high pressure threshold during the preset maximum time limit, then the Maximum Timer is reset.

If, after the Maximum Timer has been started, the measured pressure drops below the low pressure threshold and the time elapsed is less than the preset Minimum Timer time limit. This provides for robustness against false triggering due to electrical sensor faults or noisy signals.

If an out of sensor range pressure sample is detected, then opening detection of the pressure relief valve 18 is disabled by resetting the timers.

If the measured pressure rises above the preset low rail pressure threshold then the timers are reset.

The pressure relief valve 18 closes when, as a result of the fuel flow through the pressure relief valve 18, the measured pressure has dropped low enough. When the ECM 17 has detected that the pressure relief valve 18 has opened, and the valve open signal has generated, a strategy to close the pressure relief valve 18 can be initiated by the ECM 17:

a) The integral term for the high pressure pump control is reset to zero until the measured pressure drops below the low rail pressure threshold. This threshold is below the pressure required to close the pressure relief valve 18 (the closing pressure) when the fuel flow is at maximum demand. This action has the effect of stopping the high pressure pump 14 from pumping. When the measured pressure drops below the closing pressure, this allows the pressure relief valve 18 to close and the measured pressure will continue to drop until the measured pressure drops below the low pressure threshold.

b) The high pressure pump 14 is then allowed to resume (the integral term no longer set to zero) to enable the rail pressure to increase, initially with a maximum limit applied to desired rail pressure. This reduced maximum pressure limit avoids excessive pressure overshoot in the pressurised fuel source whilst pump control is regained by the high pressure fuel pump closed loop controller.

Although the control of the pressure relief valve 18 has been described above in connection with a common rail fuel system, this may also be used in any one of a variety of different fluid systems and with any one of a variety of different fluids. For example, the pressure relief valve may be used with other types of fuel systems, lubrication systems, work implement actuation systems, transmission systems, cooling systems, and other hydraulic systems where protection from excessive pressures may be desired.

The control system of the present disclosure provides a more robust determination of the pressure relief valve opening and a quicker reseat strategy. The strategy avoids raising an event to the machine operator if the problem giving rise to the opening of pressure relief valve can be automatically resolved or used to raise an event with a warning lamp or derate (i.e. a reduction in the maximum engine fuel limit, which is implemented to protect the engine 10 and to also provide an incentive for the operator to get the fault fixed).

The invention claimed is:

1. A method of controlling a fuel system of an engine, said fuel system including:

a source of high pressure fuel;

a pressure relief valve having at least one inlet fluidly coupled to the source of high pressure fuel and at least one outlet;

said pressure relief valve having a closed position in which fuel is not able to pass from the at least one inlet to the at least one outlet and at least one open position in which the fuel is able to pass from the at least one inlet to the at least one outlet;

wherein the pressure relief valve is configured to be actuated such that when a fuel pressure in the source of high pressure fuel exceeds a valve opening pressure, the fuel pressure causes the pressure relief valve to move to a first open position;

said method comprising the steps of:

continuously measuring the fuel pressure in the source of high pressure fuel;

determining whether the pressure relief valve is in an open position by determining whether the measured fuel pressure is equal to or greater than a preset high pressure threshold, which is set at the valve opening pressure;

comparing the measured fuel pressure to the preset high pressure threshold, determining whether the measured pressure falls below the preset high pressure threshold for a preset first time period;

generating an open signal if it is determined that the pressure relief valve is in the open position; and automatically, using a controller, stopping a supply of pressurized fuel to the source of high pressure fuel such that the pressure of the fuel in the source of high pressure fuel reduces and the pressure relief valve is allowed to move to the closed position.

2. The method as claimed in claim 1 in which the measured fuel pressure is compared to a plurality of preset pressure thresholds.

3. The method as claimed in claim 2 further comprising the step of comparing the measured fuel pressure with a preset low pressure threshold and determining if the measured fuel pressure falls below the preset low pressure threshold within the preset first time period.

4. The method as claimed in claim 3 further comprising the step of comparing the measured pressure with the preset low pressure threshold and determining if the measured fuel pressure falls below the preset low pressure threshold for a preset second time period.

5. The method as claimed in claim 4 further comprising the step of generating the open signal when the measured fuel pressure falls below the preset high pressure threshold for the preset first time period and falls below the preset low pressure threshold for the preset second time period.

6. The method as claimed in claim 5 in which the fuel system further comprises a high pressure fuel pump for supplying pressurized fuel to the high pressure fuel source; wherein the open signal is used to stop an operation of the high pressure fuel pump such that the pressure of the fuel in the source of high pressure fuel reduces and the pressure relief valve is allowed to move to the closed position.

7. The method as claimed in claim 6 further comprising the step of comparing the measured fuel pressure to the preset low pressure threshold and if the measured fuel pressure falls below the preset low pressure threshold, the high pressure fuel pump is switched on again until the measured fuel pressure reaches a preset regulated pressure limit which enables the engine to continue operating at a minimum level.

8. The method as claimed in claim 7 in which the preset high pressure threshold is lower than the valve opening pressure.

9. The method as claimed in claim 8 in which the preset low pressure threshold is lower than the valve opening pressure and the preset high pressure threshold.

10. The method as claimed in claim 9 further comprising a step of restarting the comparing the measured fuel pressure to the preset high pressure threshold, and the determining whether the measured pressure falls below the preset high pressure threshold for a preset first time period in the event that at least one of the following occurs:

a) the measured fuel pressure exceeds the preset high pressure threshold during the preset first time limit;

b) the measured fuel pressure drops below the preset low pressure threshold and a time elapsed is less than a preset minimum time limit after the first preset time period has started;

c) if an out of sensor range measured pressure sample is detected;

d) if the measured fuel pressure rises above the preset low pressure threshold.

11. The method as claimed in claim 9 further comprising a step of restarting the steps of comparing the measured fuel pressure with the preset low pressure threshold and determining if the measured fuel pressure falls below the preset low pressure threshold within the preset first time period in the event that at least one of the following occurs:

a) the measured fuel pressure exceeds the preset high pressure threshold during the preset first time limit;

b) the measured fuel pressure drops below the preset low pressure threshold and a time elapsed is less than a preset minimum time limit after the first preset time period has started;

c) if an out of sensor range measured pressure sample is detected;

d) if the measured fuel pressure rises above the preset low pressure threshold.

12. The method as claimed in claim 9 further comprising a step of restarting the step of comparing the measured pressure with the preset low pressure threshold and determining if the measured fuel pressure falls below the preset low pressure threshold for the preset second time period in the event that at least one of the following occurs:

a) the measured fuel pressure exceeds the preset high pressure threshold during the preset first time limit;

b) the measured fuel pressure drops below the preset low pressure threshold and a time elapsed is less than a preset minimum time limit after the first preset time period has started;

c) if an out of sensor range measured pressure sample is detected;

d) if the measured fuel pressure rises above the preset low pressure threshold.

13. The method as claimed in claim 9 further comprising a step of restarting a step of generating the open signal when the measured fuel pressure falls below the preset high pressure threshold for the preset first time period and falls below the preset low pressure threshold for the preset second time period in the event that at least one of the following occurs:

a) the measured fuel pressure exceeds the preset high pressure threshold during the preset first time limit;

b) the measured fuel pressure drops below the preset low pressure threshold and a time elapsed is less than a preset minimum time limit after the first preset time period has started;

c) if an out of sensor range measured pressure sample is detected;

d) if the measured fuel pressure rises above the preset low pressure threshold.

14. A fuel system for an engine comprising:

a source of high pressure fuel;

a pressure relief valve having at least one inlet fluidly coupled to the source of high pressure fuel and at least one outlet;

said pressure relief valve having a closed position in which a fuel is not able to pass from the at least one inlet to the at least one outlet and at least one open position in which the fuel is able to pass from the at least one inlet to the at least one outlet;

wherein the pressure relief valve is actuated such that when a fuel pressure in the source of high pressure fuel exceeds a valve opening pressure, the fuel pressure causes the pressure relief valve to move to a first open position;

monitoring means for measuring the fuel pressure in the source of high pressure fuel; and a controller configured to determine when the pressure relief valve is in an open position by determining whether the measured fuel pressure is equal to or greater than a preset high pressure threshold, which is set at the valve opening pressure and to generate a valve open signal if it is determined that the pressure relief valve is in the open position, said controller configured to carry out said determining by:

comparing the measured fuel pressure to the preset high pressure threshold, and determining whether the measured pressure falls below the preset high pressure threshold for a preset first time period; and said controller further configured to stop a supply of pressurized fuel to the source of high pressure fuel such that the pressure of the fuel in the source of high pressure fuel reduces and the pressure relief valve is allowed to move to the closed Position.

15. The fuel system as claimed in claim 14 in which the measured fuel pressure is compared to a plurality of preset pressure thresholds.

16. The fuel system as claimed in claim 15 further comprising a high pressure fuel pump for supplying a pressurized fuel to the source of high pressure fuel, wherein the valve open signal stops an operation of the high pressure fuel pump such that the pressure of the fuel in the source of high pressure fuel reduces and the pressure relief valve is allowed to move to the closed position.

17. The fuel system as claimed in claim 16 in which the preset high pressure threshold is lower than the valve opening pressure.

18. The fuel system as claimed in claim 17 in which a preset low pressure threshold is lower than the valve opening pressure and the preset high pressure threshold.

* * * * *